US006868571B1

(12) United States Patent
Fischer et al.

(10) Patent No.: US 6,868,571 B1
(45) Date of Patent: Mar. 22, 2005

(54) MEMO RECORDER/TAPE MEASURING MODULE

(75) Inventors: Ernie Fischer, Skokie, IL (US); Tim LeBeau, Lisle, IL (US); Peter W. Neumann, Chicago, IL (US)

(73) Assignee: Credo Technology Corporation, Broadview, IL (US)

( * ) Notice: Subject to any disclaimer, the term of this patent is extended or adjusted under 35 U.S.C. 154(b) by 0 days.

(21) Appl. No.: 10/681,795

(22) Filed: Oct. 8, 2003

(51) Int. Cl.[7] ..... B25F 1/00
(52) U.S. Cl. ..... 7/164; 7/170; 33/760
(58) Field of Search ..... 7/164, 170; 33/760

(56) References Cited

U.S. PATENT DOCUMENTS 5,040,256 A * 8/1991 Mills ..... 7/164
5,810,420 A 9/1998 Welling

* cited by examiner

*Primary Examiner*—James G. Smith
(74) *Attorney, Agent, or Firm*—Greer, Burns & Crain, Ltd

(57) ABSTRACT

A selectively detachable measuring and recording module for use with a hand tool including a module housing configured to be assembled to the hand tool, a measuring device coupled to the module housing, and a sound recording and playback device disposed within the module housing.

52 Claims, 11 Drawing Sheets

MEMO RECORDER/TAPE MEASURING MODULE

BACKGROUND OF THE INVENTION

The present invention relates generally to modules for use with hand tools, and more particularly relates to recording and/or measuring modules for use with such hand tools.

There has been continued innovation and improvement in the design of accessories for hand tools, particularly with regard to accessories that enhance an operator's ability to perform a task upon a work surface. Examples of such hand tools are those produced under the Skil® and Bosch® brands by the Robert Bosch Tool Corporation of Chicago, Ill., which also produces many accessory attachments for such hand tools.

While using such hand tools, such as a drill or a saw, for example, the operator must frequently take and record measurements for subsequent cutting or drilling locations, and/or make markings upon a work surface to designate the desired location. Conventional methods for conducting these processes include interrupting operation of the tool, putting the tool down, locating a measuring tape or other measuring means, taking measurements, memorizing the measurements when taken, or alternatively, locating a writing utensil and paper to write down the measurements. Additionally, when the operator wishes to designate the desired location, the operator must first locate a writing utensil or other marking tool, and subsequently make the desired markings. Thus, the operator must keep track of a measuring device, a marking device, or rely on memory to make and remember precise and accurate measurements.

SUMMARY OF THE INVENTION

The present invention is related to a recording and/or measuring module that provides for quick and secure attachment and detachment from a band tool of the type having a housing configured to receive the module.

The recording and/or measuring module of the present invention includes a housing that is configured to quickly and securely attach and detach from the hand tool housing, and may include a sound recording and playback device, a measuring device, or both. The module may further include a switch for controlling recording and playback modes, and a LED display for indicating operation of the module, and an actuator for actuating the module during either of the recording and playback modes.

DETAILED DESCRIPTION OF THE INVENTION

Figure 1:
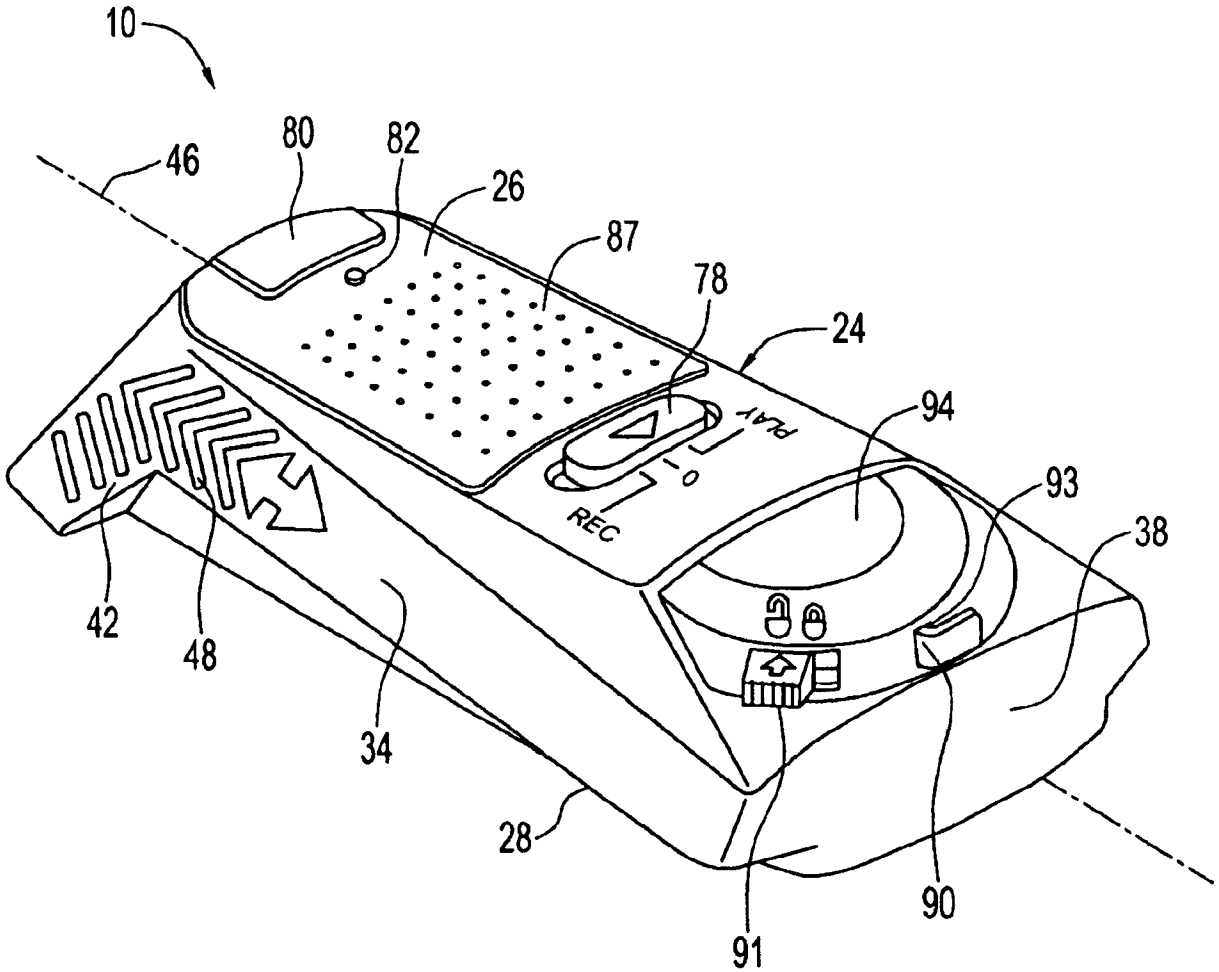
FIG. 1 is a front perspective view of a recording and measuring module of the instant invention.

Turning now to FIG. 1, the preferred embodiment of the recording and/or measuring module of the instant invention, designated generally at 10, is typically used in connection with powered rotary hand tools such as drills, hammer drills, jigsaws, circular saws, bench top saws, and any other tool that may require the operator to create and record measurements. For purposes of illustration only, the recording and/or measuring module 10 of the preferred embodiment will be shown in connection with a powered hand drill 12 (best shown in FIGS. 6 and 7) that is illustrated in the drawings, which is manufactured by the Robert Bosch Tool Corporation under the Skil® brand. The powered hand drill 12 has a generally cylindrical housing 14 with an output shaft 16 at a first end thereof, to which a drill bit (not shown) is ordinarily attached. A handle portion 18 depends downwardly from a bottom portion of the housing 14, generally at a right angle thereto. If the drill is a cordless drill, a battery 20 may be provided at a bottom end of the handle portion 18. The housing 14 is preferably further configured to include a receiving portion 22 for securely receiving the module 10.

The dimensions and configuration of the module 10 may vary depending upon the hand tool with which it is to be used. Typically, the module 10 is configured and dimensioned for quick and easy attachment and detachment from the hand tool with which it is used, preferably having minimal size so as not to greatly increase the overall size of the hand tool. However, the instant invention also contemplates a module that is integral to and unitary with the hand tool, and is thus not separable from the hand tool.

Figure 5:
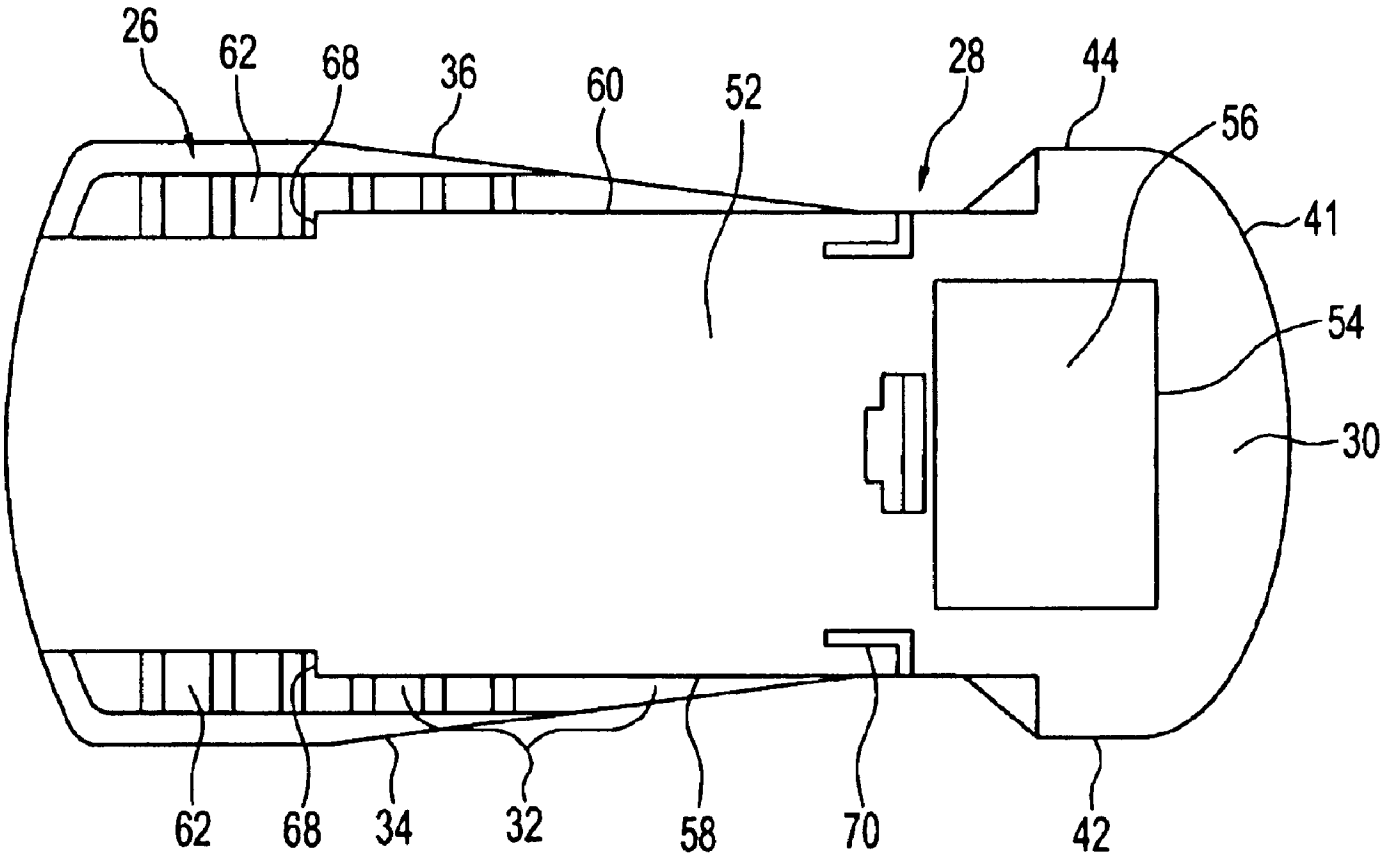
FIG. 5 is a bottom elevational view of the recording and measuring module of the instant invention.
Figure 6:
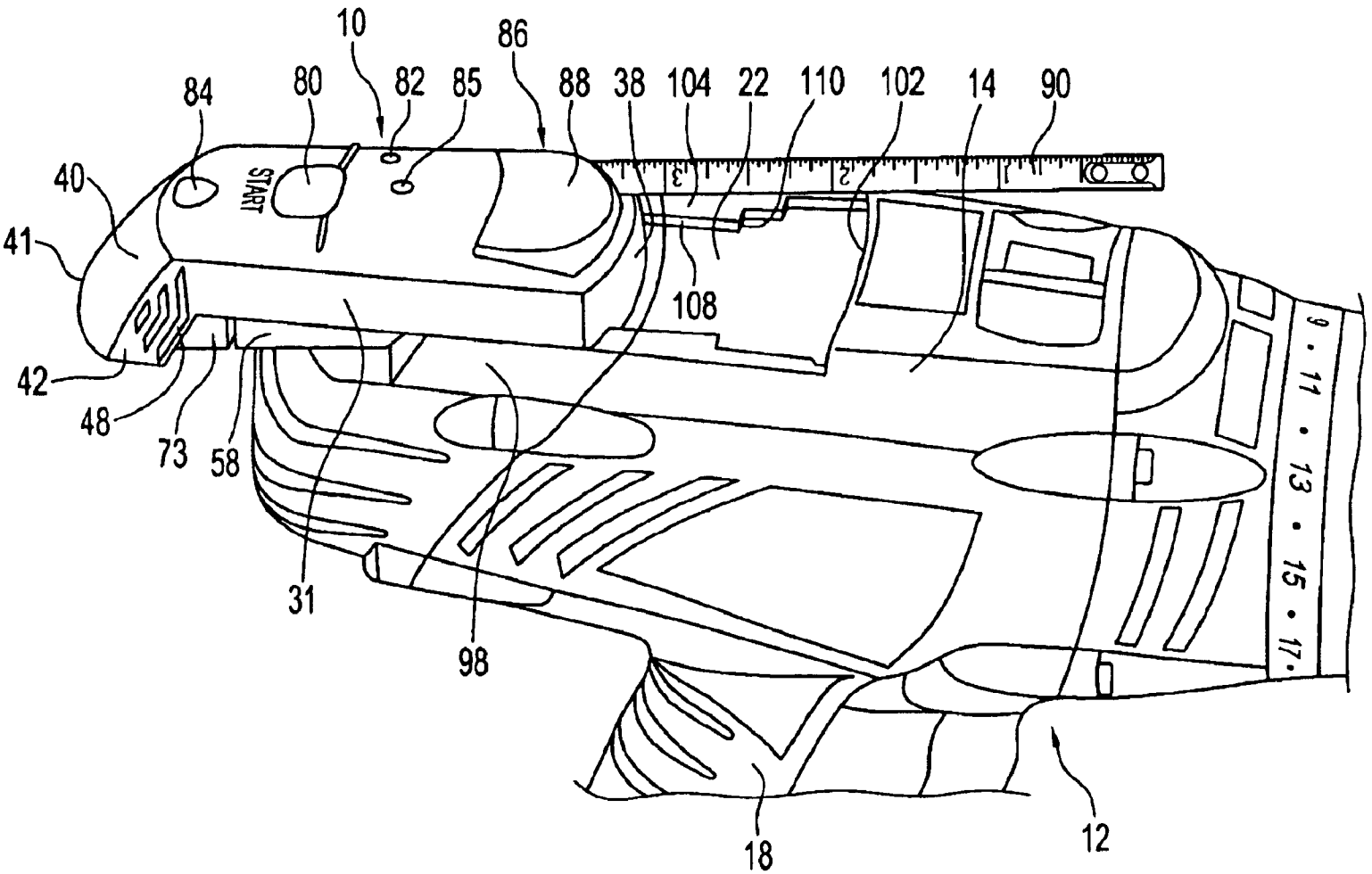
FIG. 6 is a side elevational view of the recording and measuring module illustrated in FIG. 1 partially coupled to a hand tool.
Figure 7:
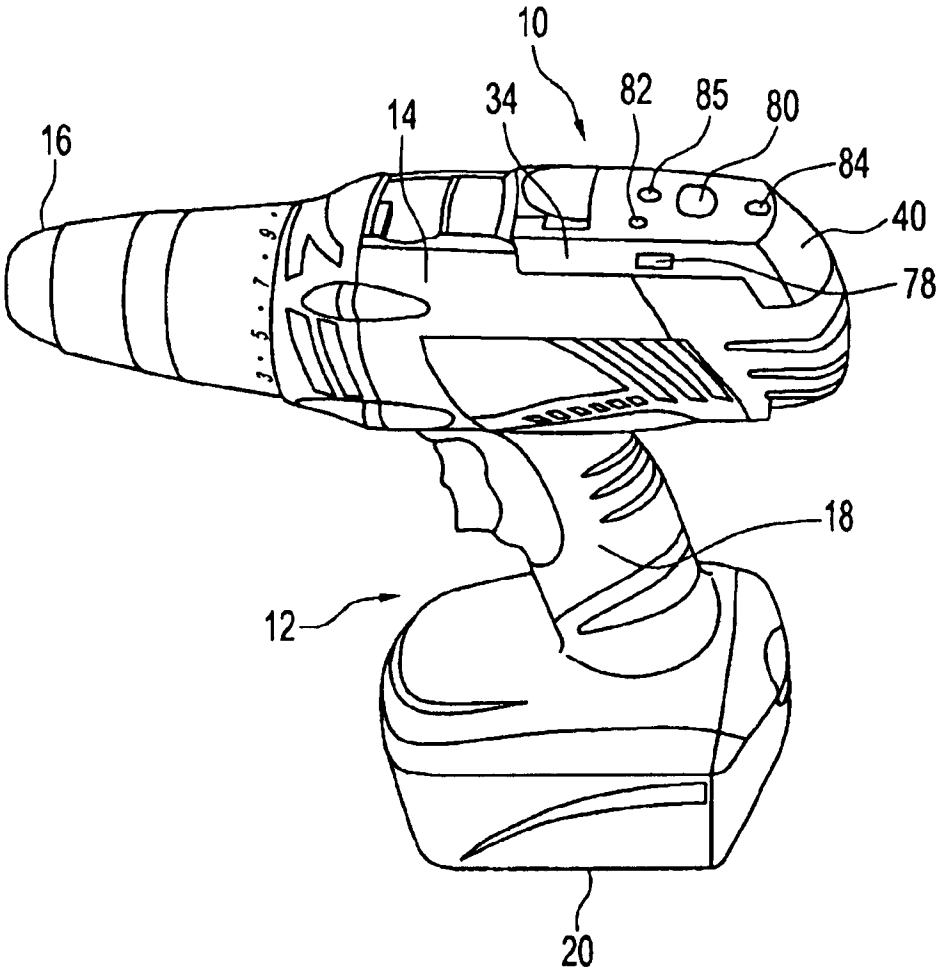
FIG. 7 is a side elevational view of the recording and measuring module illustrated in FIG. 1 coupled to a hand tool.
Figure 8:
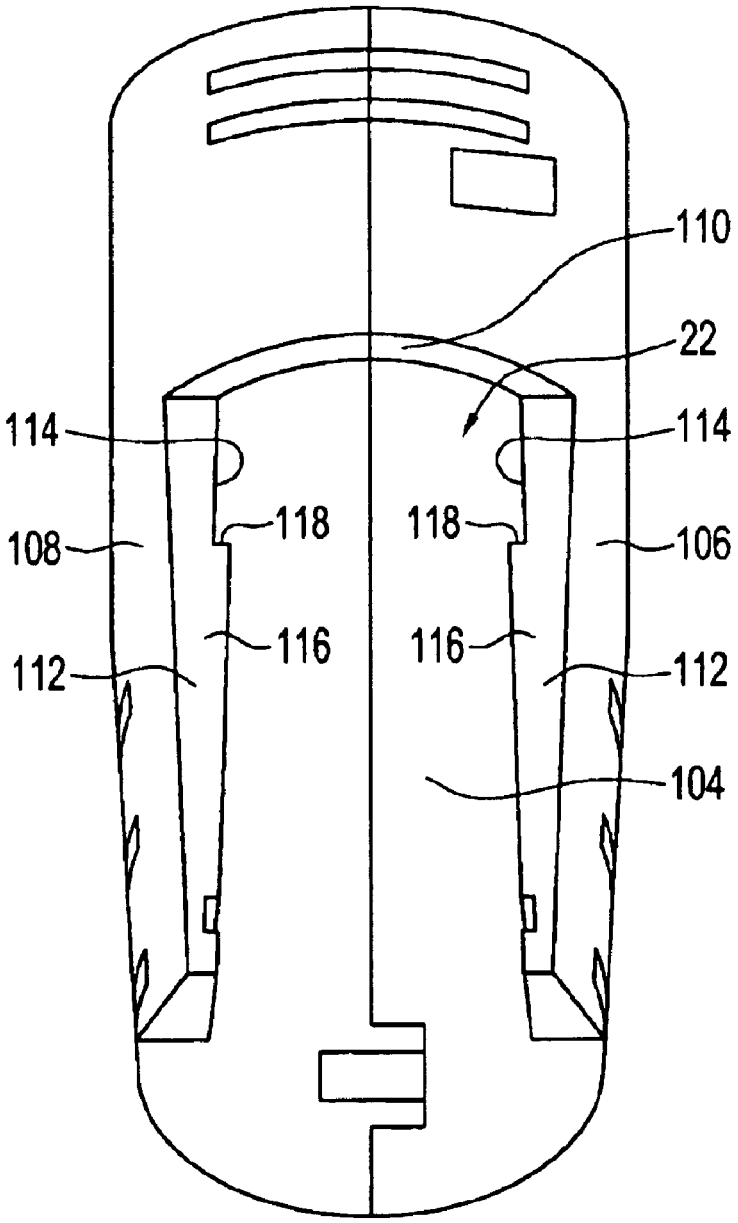
FIG. 8 is a top elevational view of a hand tool to which the module may be coupled.

For purposes of illustration only, the module 10 is sized and configured for use with the powered hand drill 12 illustrated in FIGS. 6 and 7. More specifically, the module 10 includes a housing 24 having a slightly curved top member 26 and a generally flat, planar bottom member 28 (best shown in FIG. 5). The bottom member 28 is generally rectangular in shape with an arcuate front portion 30, the diameter of which is preferably slightly larger than a width of a rectangular portion 32.

While the top and bottom members 26, 28 may have unitary construction, they are preferably two discrete pieces that matingly engage one another to form the single housing 24. To this end, both the top and bottom members 26, 28 include features to promote mating engagement, as well as the formation of the singular module housing 24 once engaged. For example, it is contemplated that the module 10 of the instant invention could be coupled to the desired hand tool in a number of manners, such as a sliding engagement, a snap-fit engagement, frictional engagement, or threaded engagement, to name a few. Additionally, the hand drill 12 may optionally include a recess that is configured to matingly receive and enclose the module 10, which is retained within the recess. For purposes of illustration only, the module 10 of the instant invention will be shown coupled to the powered hand drill 12 via sliding engagement.

The top member 26 of the module 10 includes downwardly depending side walls 34, 36, a downwardly depending rear wall 38, and a downwardly sloping front wall 40 that preferably includes an arcuate bottom edge 41. The front wall 40 itself includes a pair of side flanges 42, 44 that are preferably unitary with the side walls 34, 36. A narrowest width of the top member 26 is defined at a point where the side flanges 42 and 44 join the side walls 34, 36, with the width of the top member 26 gradually increasing from that point to a rear end of the top member. Thus, while the side walls 34, 36 depend downwardly from the top member 26, along their lengths they extend away from a longitudinal axis 46 of the module 10 at an acute angle. Because the side flanges 42, 44 provide a gripping surface for the operator to use while attaching and detaching the module 10, the side flanges are provided with texturing 48 to enhance gripping properties, such as scored or raised configurations. While the texturing 48 may assume a variety of configurations, the texturing is preferably a plurality of raised lines or raised arrowhead shaped configurations.

Turning now to FIG. 5, the bottom member 28 of the module 10 includes a top surface 50, a generally planar bottom side 52, and a cavity 54 therethrough that provides access to a hollow portion of the assembled housing 24 for enclosing a battery or other modular power source. A cover member 56 engages an opening of the cavity 54 via snap-fit or other secure engagement. The arcuate front portion 30 of the bottom member 28 is configured to nestingly engage the arcuate edge 41 of the front wall 40 of the top member 26. However, the rectangular portion 32 is not sized and configured to nestingly engage a corresponding portion of the top member 26. Instead, because the rectangular portion 32 includes generally parallel side walls 58, 60, while the top member 26 has side walls 34, 36 that extend away from the longitudinal axis 46 of the module 10 at an acute angle, the gradually widening width of the top member is larger than the constant width of the bottom member, forming an pair of eaves 62 on the top member, one of which hangs over each side of the bottom member.

To optimally maintain the overall dimension of the powered hand drill 12, the width of the top member 26, as measured from an outside of one eave 62 to an outside of the other cave, is generally configured to correspond to a width of the receiving portion 22 of the tool housing. Because the bottom member 28 has a smaller width than the top member 26, when the top and bottom members 26, 28 are engaged, the eaves 62 and the parallel side walls 58, 60 form a pair of sliding guide tracks. To promote the guidance properties of the sliding guide tracks, the rectangular portion 32 includes a guidance mechanism at each side of the rectangular portion.

More specifically, the rectangular portion 32 of the bottom member 28 preferably includes at least two discrete widths, separated by a transition section 68. A first width is followed by the transition section 68, which is followed by a second width that is preferably larger than the first width. Because of the disparity in width, the second width acts as a guide flange.

Both the first and second widths are preferably smaller than even the narrowest point of the top member 26. The second width includes the generally parallel side walls 58, 60, which extend upward from a top surface 50 (best shown in FIG. 9) and slope upward toward the arcuate front portion 30, and are therefore shortest at the transition section 68 and tallest near the arcuate front portion.

Figure 9:
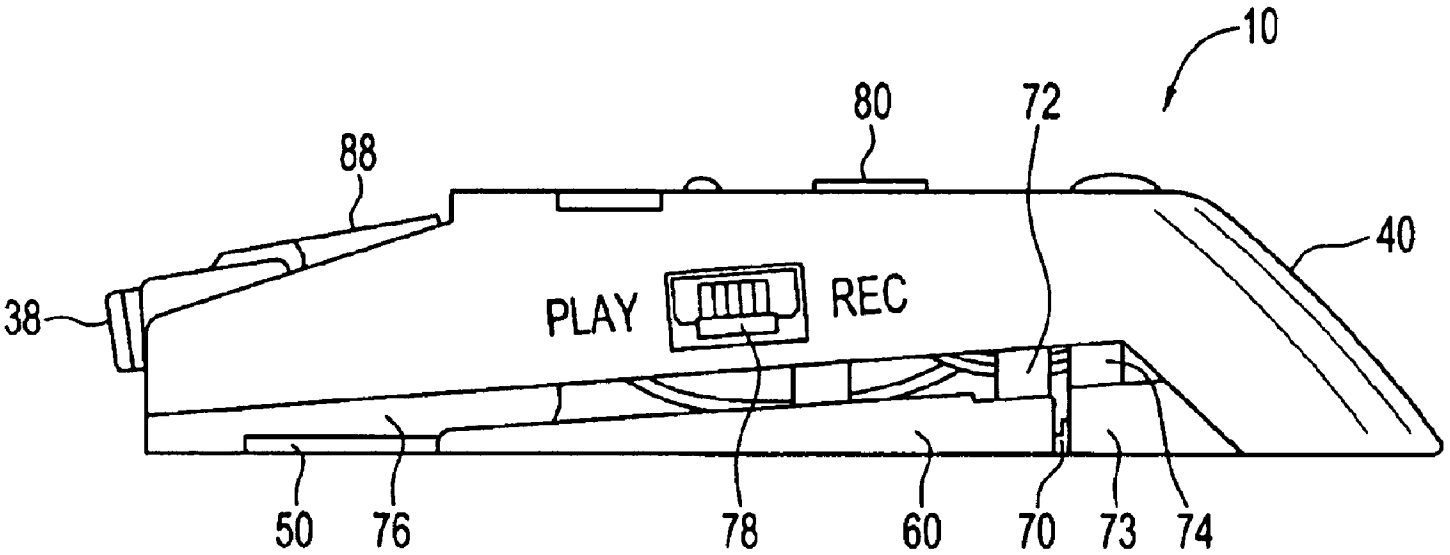
FIG. 9 is a side elevational view of the recording and measuring module illustrated in FIG. 1.

Turning now to FIG. 9, at an end of the rectangular portion 32 nearest the arcuate front portion 30, the parallel side walls 58, 60 each include engagement mechanisms. Each engagement mechanism includes a longitudinal slot 70 in the bottom member 28 and at least one engagement member 72 extending upward from the top surface 50 of the bottom member on each side. Optionally, a second engagement member 74 may depend from an underside of the top member 26 to a corresponding recess (not shown) in the bottom member on each side. Thus, the engagement member 72 extends into a corresponding recess (not shown) within the top member 26 to promote engagement and stability to the assembly of the top member 26 to the bottom member 28, and the top member 26 similarly includes an engagement member 74, which extends into a corresponding recess (not shown) within the top surface 50 of the bottom member 28.

Because the module is preferably made from a plastic, such as Acrylonityile Butadiene Styrene (ABS) for example, the proximity of the each longitudinal slot 70 to the parallel side walls 58, 60 imparts localized flexibility to the respective portion of the parallel side walls that abut each longitudinal slot. Thus, those portions of the parallel side walls 58, 60 have flexible, spring-like qualities that promote the secure engagement of the module 10 to the powered hand drill 12. A notch 73 is preferably disposed on a section of the parallel side walls 58, 60 opposite the longitudinal slot 70. The notch 73 preferably slightly increases the width of the parallel side walls 58, 60.

To assemble the top and bottom members 26, 28 to one another, the top surface. 50 of the bottom member 28 is brought toward an underside of the top member 26 that when coupled, enclose the hollow portion of the assembled housing 24. The arcuate front portion 30 of the bottom member 28 nests within the arcuate bottom edge 41 of the front wall 40 so that the arcuate bottom edge 41 and the bottom side 52 of the bottom member 28 are generally coplanar. Similarly, the rectangular portion 32 abuts an inside surface of the rear wall 38 of the top member 26 such that the bottom side 52 of the bottom member 28 and a bottom edge of the rear wall 38 are coplanar. Additionally, at least a longitudinal portion of the top side of the bottom member 28 abuts a pair of opposing support walls 76 that extend downwardly from the top member 26. Each respective engagement member 72, 74 engages its corresponding recess to promote the stability, alignment and security of the engagement of the top and bottom members 26, 28. To further reinforce the engagement, the two members 26, 28 may be secured to one another by ultrasonic welding or by application of an adhesive, such as Loctite® glue for example.

In the preferred embodiment of the instant invention, the top member 26 includes a plurality of additional features to enhance the user's operation of the hand tool, such as a multiple position mode switch 78, an actuator 80, an LED display 82, a microphone 84, a speaker 85 and a measuring device 86. While the preferred embodiment includes all of these features, it is contemplated that alternative embodiments may omit one or more of these features. Moreover, placement and configuration of these features, when present, may vary greatly depending upon the application with which the module 10 is intended for use and upon the specifications of a manufacturer or a customer.

The mode switch 78 is preferably provided so that the operator may select between a plurality if operating modes, such as the off mode, the recording mode and the playback mode. The mode switch 78 may be disposed in a plurality of locations. For example, as illustrated in FIGS. 1–4, the mode switch 78 is disposed toward a center of the top surface 50 of the top member 26, while it may also be disposed on one of the downwardly depending side walls 34, 36 in an alternative embodiment, as illustrated in FIGS. 6 and 9.

The actuator 80 is preferably a pushbutton or key member, which when depressed, activates either the recording mode or the playback mode, depending on which mode the user has selected. As with the mode switch 78, the actuator 80 may be disposed at a rear surface of the top member 26, as illustrated in FIGS. 1–4, or may be disposed in a plurality of alternative positions, such as toward the middle of the top member 26, as illustrated in FIG. 6. An LED display 82 is also preferably provided to indicate when a particular mode is activated, such as when the module 10 is recording. Again, the LED display may also be disposed in a plurality of locations, such as toward the middle of the top member 26 as illustrated in FIG. 6, or near the rear of the top member, as illustrated in FIGS. 1–4.

Because the module 10 is configured to record and play back audible sound, the module also preferably includes the microphone 84 and the speaker 85. The microphone 84 and speaker 85 may optionally be combined into a microphone/speaker 87 feature, as illustrated in FIGS. 1–4. Either way, the microphone 84, speaker 85 and combined microphone/speaker 87 feature may disposed at a plurality of locations, dependent only upon the desires and specification of the manufacturer or customer. As illustrated in FIGS. 1–4, the combined microphone/speaker 87 feature is disposed along the top surface 50 of the top member 26 toward the middle, while FIG. 6 illustrates the microphone 84 as disposed at a front surface of the top member, and the speaker 85 as being disposed toward the middle of the top member.

The measuring device 86, which is part of the preferred embodiment but which can be optionally removed, is preferably a tape measure that includes a spool housing 88 and measuring tape 90 having a predetermined length, such as three feet, for example. Optionally, a locking lever 91 is also provided to prevent inadvertent extension or retraction of the measuring tape 90 during measurement or when the measuring tape is fully retracted. When a measuring device 86 is provided, the housing 24 of the module 10 is preferably configured to receive the measuring device.

More specifically, in the preferred embodiment of the instant invention, the housing 24 includes a generally circular recess at a portion of the top member 26 nearest the rear wall 38, which is configured to receive a spool housing 88 of a predetermined size and configuration. Additionally, at least a portion of the spool housing 88, and preferably the entire spool housing 88, is enclosed by a top wall of the top member 26. The spool housing 88 is preferably oriented so that its axis of rotation is perpendicular to the longitudinal axis 44 of the module 10. In this manner, a smooth, the top surface 50 of the top member 26 encloses the spool housing 88 without substantially disrupting the topography of the top surface 50 of the module 10. The measuring device 86 is also preferably configured to be selectively removable from the housing 24 in the event the user wishes to take a measurement without having to hold the drill while doing so.

Further accommodation is preferably made for the measuring tape 90, which preferably extends from the spool housing with its broad sides facing the side walls 34, 36 of the top member 26. A slot 93 is preferably provided in the rear wall 38 of the top member 26 to both accommodate the extension and retraction of the measuring tape 90 and to guide the measuring tape.

Figure 2:
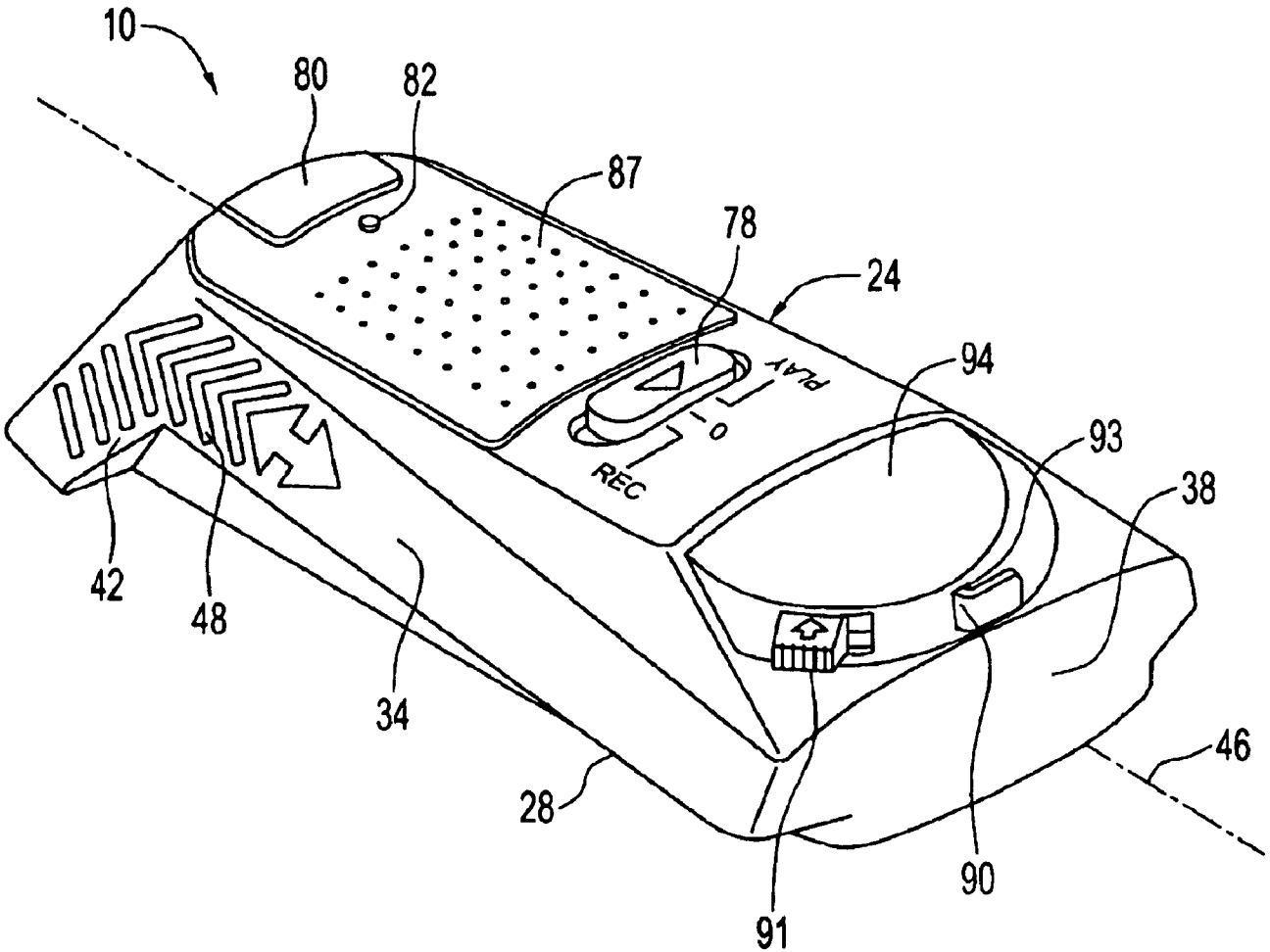
FIG. 2 is a front perspective view of an alternative embodiment of the recording and measuring module illustrated in FIG. 1.

Turning now to FIG. 2, in one alternative embodiment, the measuring device 86 is integrally formed with the housing 24 so that the spool housing 88 is preferably entirely or mostly enclosed within the housing. The slot 93 is still provided so that the user may grasp, extend and retract the measuring tape 90. In this embodiment, the measuring device 86 is still oriented with its axis of rotation preferably perpendicular to the longitudinal axis 44 of the module 10. However, instead of the generally circular recess 92, the housing 24 is generally continuous and unbroken over the measuring device 86, and encloses the measuring device 86 under a raised, generally circular portion 94 of the top member 26.

Figure 3:
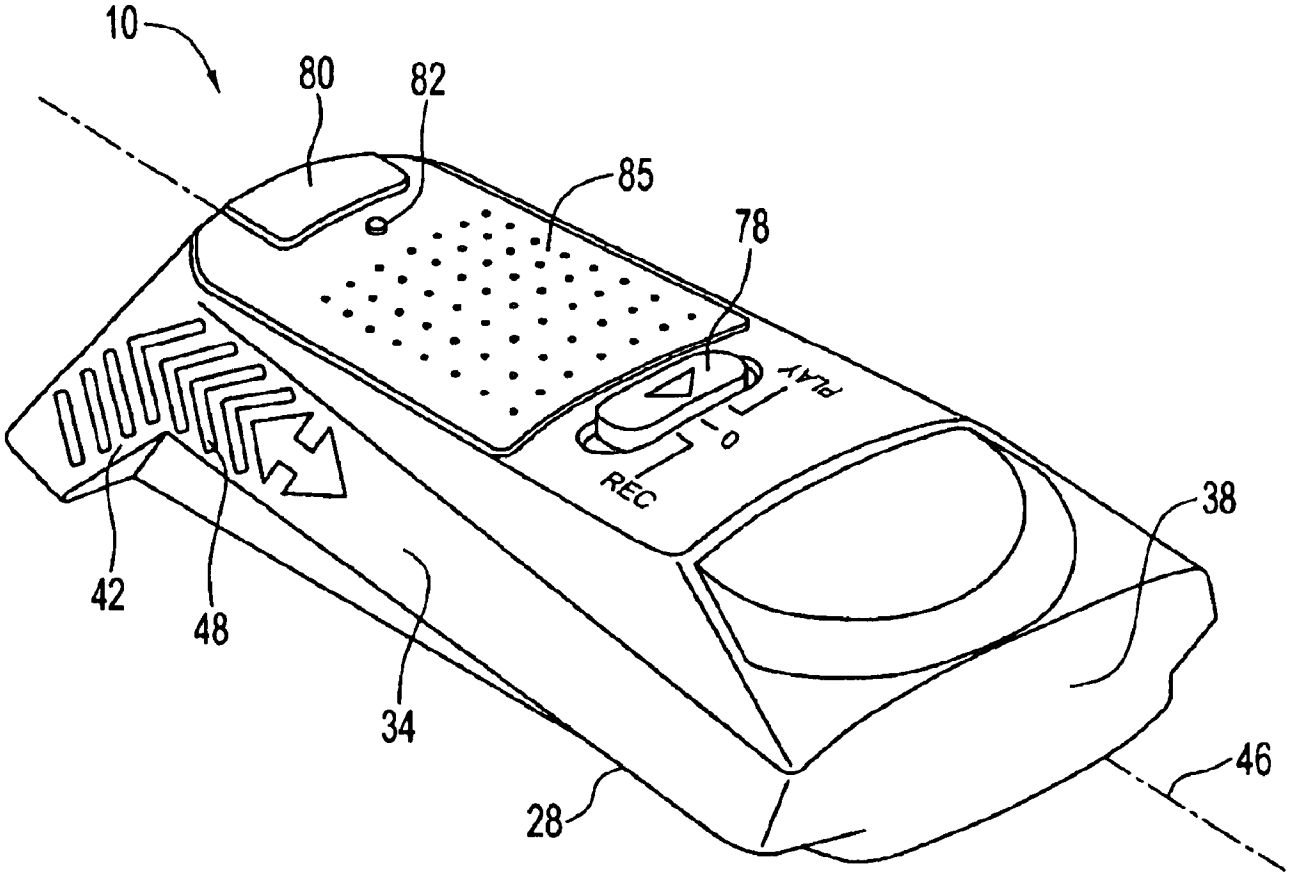
FIG. 3 is a front perspective view of another alternative embodiment of the recording and measuring module illustrated in FIG. 1.

Turning to FIG. 3, another embodiment of the instant invention omits the measuring device 86 altogether. In this embodiment, the portion of the top member 26 nearest the rear wall 38 is therefore not configured to accommodate a measuring tape, and is preferably a generally smooth surface on the top member 26.

Figure 4:
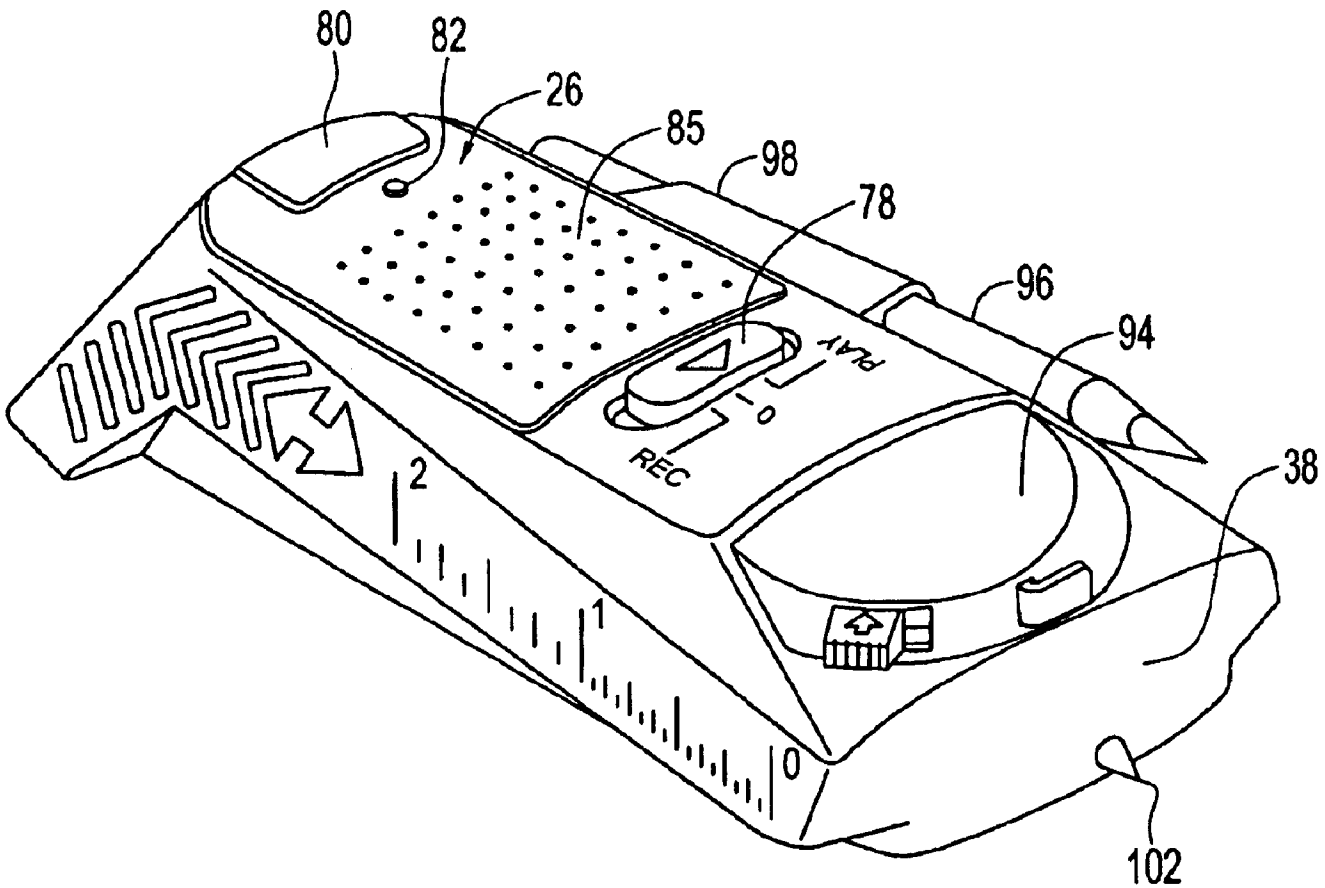
FIG. 4 is a front perspective view of yet another alternative embodiment of the recording and measuring module illustrated in FIG. 1.

Additionally, the module 10 of the instant invention contemplates the inclusion of numerous other utilities, such as a writing utensil or a marking utensil. For example, as illustrated in FIG. 4, a writing utensil 96, such as a pencil or a pen for example, is secured to the module 10 using a generally hollow, tubular fastener 98 that has an orifice therethrough that is generally sized and configured to frictionally engage and retain the writing utensil. Preferably, the writing utensil 96 is secured to the module so that its longitudinal axis is parallel to the longitudinal axis 46 of the module 10. Alternatively, a marking utensil having a sharpened point may be included, such as a plastic or metal point.

As is also illustrated in FIG. 4, the alternative embodiments of the module 10 may include measurement indicia 100 along one of the two downwardly depending side walls 34, 36, thus adding an incremental possibility for length measurement of the work surface. Specifically, at least a portion of the module 10 is preferably configured so that it includes a predetermined length that corresponds to an integer unit measurement, such as two inches. The integer unit measurement has a value of zero at a position on the downwardly depending side walls 34, 36 generally corresponding to the position at which the tape measure 86 is fully retracted. Thus, as the tape measure 86 is extended, the user is able to make measurements up to and including the length of the tape measure plus the added two inches, for example.

Additionally, the module 10 may optionally include a honed point 102 extending therefrom, preferably at downwardly depending rear wall 38. This honed point 102 may be used to make point indentations for marking desired locations on a work surface, and identifying those locations for drilling, or inserting a nail or screw, for example.

Figure 11:
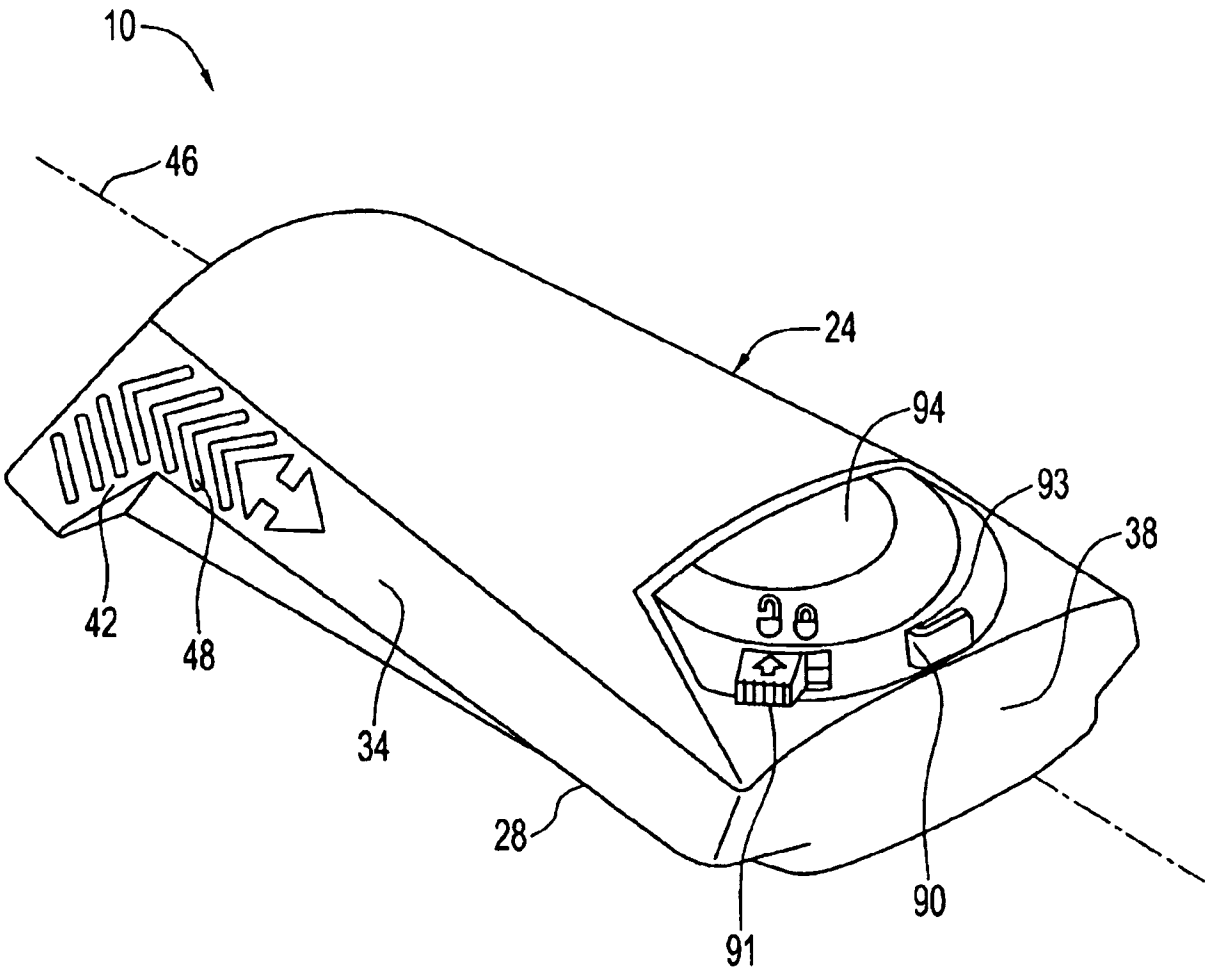

FIG. 11 illustrates yet another embodiment wherein the recording and playback device is omitted from the module 10, while the measuring device 86 is still provided. In this embodiment, the measuring device 86 is preferably provided at within the module 10, which is configured to be assembled to the powered hand drill 12 at a top portion of the housing 24.

The recording and playback device that is provided is preferably a single chip voice record/ playback device that can preferably record 10 or 12 seconds or more and are commercially available and can be connected in circuit with the LED 82 microphone 84, speaker 85, switch 78 and actuator 80, as well as a battery (not shown). Such a device is currently marketed as product ISD I100 series by the ISD Company of 2727 N. First St., San Jose, Calif. 95134. A circuit diagram for a common application such as that used in these embodiments is illustrated in product brief ISD1100PBfl-699 which is specifically incorporated by reference herein.

Where the module 10 is intended to be selectively detachable from the powered hand drill 12, the receiving portion 22 is provided on the powered hand drill and is preferably disposed within a top surface of the cylindrical housing 14, beginning at an end of the housing opposite the output shaft 16 and extending in a longitudinal direction along at least a portion of the top surface. For example, the receiving portion 22 may extend along substantially half of the length of the housing. A bottom surface 104 of the receiving portion 22 is a generally planar, downwardly sloping surface, open at the end opposite the output shaft 16 and flanked on each lateral side by outer walls 106, 108. The open end is preferably arcuate in shape. An end of the receiving portion 22 nearest the output shaft 16 terminates in an arcuate wall 110.

The outer walls 106, 108 are configured to receive the module 10 in a sliding engagement. Accordingly, each outer wall 106, 108 extends upwardly from the bottom surface 22 to a predetermined height. The outer walls 106, 108 are sloped so that the height of each of the outer walls gradually increases in the direction of the open end. In maintaining the overall general cylindrical shape of the housing 14, outer surfaces of the outer walls 106, 108 are preferably curved. Top surfaces 112 of the outer walls 106, 108 are generally planar and have a width that is preferably larger than that of a bottom width of the outer walls, thus creating an overhang that extends into an interior space of the receiving portion 22. An underside of the overhang creates a pair of longitudinal recesses 114 that are configured to receiving the module 10. One of a pair of flanges 116 extends toward one another from each top surface 112 of the outer walls 106, 108. The distance each flange 112 extends toward the other flange increases in a direction from a notch 118 toward the arcuate wall 110.

Thus, to couple the assembled module 10 to the powered hand drill 12, the eaves 62 are placed in abutment with the top surfaces 112 of the outer walls 106, 108, thus placing the bottom member 28 of the module in alignment with the longitudinal recesses 114 of the receiving portion 22. The eaves 62 preferably slide atop the top surfaces 112 of the outer walls 106, 108 in a direction of the arcuate wall 110 of the receiving portion, thereby engaging the parallel side walls 58, 60 of the bottom member 28 with the longitudinal recesses 114. The module 10 preferably slides into the receiving portion 22 in this manner until the longitudinal recesses encounter the notch 73. At this point, the user supplies an additional quantum of force to push the notch 73 into the longitudinal recesses 114, thereby fully coupling the module 10 to the powered hand drill 12, wherein the arcuate bottom edge 41 of the downwardly sloping front wall 40 of the top member 26 abuts the arcuate wall 110 of the powered hand drill. At the rear, the downwardly depending rear wall 38 abuts a generally smooth, rounded portion of the powered hand drill 12 so that the rear wall 38 and the smooth rounded portion of the powered hand drill are generally coextensive. The side flanges 42, 44 abut an end of the outer walls 106, 108. In this manner, the module 10 is coupled to the powered hand drill 12 such that edges of the module and edges of the receiving portion 22 abut one another to provide a generally smooth and unobtrusive coupling, preferably leaving no exposed edges on either the receiving portion or the module.

Uncoupling the module 10 from the powered hand drill 12 is similarly smooth and efficient. The operator applies force in a downward and rearward direction to overcome the engagement of the notch 73 within the longitudinal recesses 114. Once this engagement is overcome, the operator slides the module 10 out of the receiving portion 22 to fully disengage the module from the powered hand drill 12.

Figure 10:
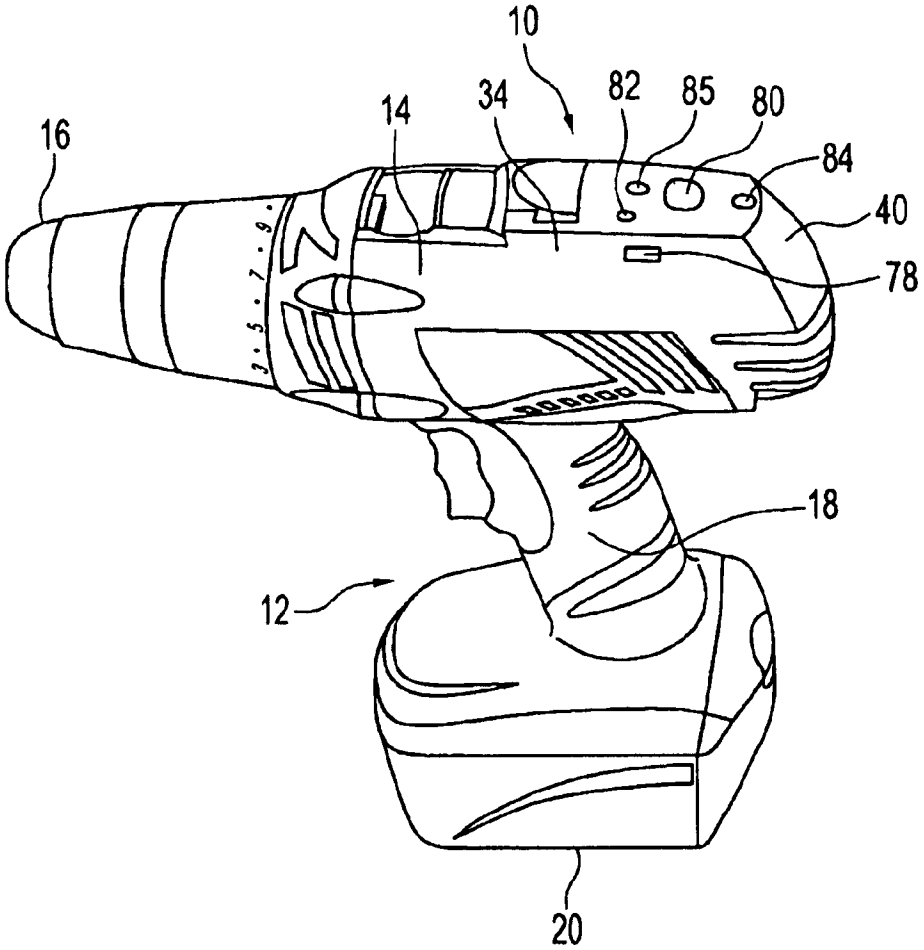
FIG. 10 is a perspective view of another alternative embodiment of the recording and measuring module and hand tool that are of a unitary construction.

Turning now to FIG. 10, where the module 10 and the powered hand drill 12 or other hand tool are of unitary construction, no coupling or uncoupling of the module is anticipated. As such, the overall shape of the combination module 10 and powered hand drill 12 is generally similar to that of the coupled module and powered hand drill in embodiments where the module and powered hand drill are separate units. However, unlike previous embodiments, the housing is unitary and accordingly lacks discrete demarcation between the two pieces.

The unitary combination module 10 and powered hand drill 12 includes the generally cylindrical housing 14 with the output shaft 16 at a first end thereof, to which a drill bit (not shown) is ordinarily attached. The handle portion 18 depends downwardly from the bottom portion of the housing 14, generally at a right angle thereto. If the drill is a cordless drill, the battery 20 may be provided at the bottom end of the handle portion 18. In contrast to earlier embodiments, however, there is no receiving portion provided at the end opposite the output shaft 16. Instead, the radius of the top surface of the powered hand drill is generally maintained throughout its length, with the components of the module 10 enclosed therein. The components are included within the fabricated housing using methods that are well known in the art.

While a particular embodiment of the present recording and/or measuring module has been described herein, it will be appreciated by those skilled in the art that changes and modifications may be made thereto without departing from the invention in its broader aspects and as set forth in the following claims.

What is claimed is:

1. A selectively detachable measuring and recording module for use with a hand tool comprising:

a module housing configured to be assembled to the hand tool;

a measuring device coupled to said module housing; and a sound recording and playback device disposed within said module housing.

2. The module of claim 1 wherein said module housing includes coupling means for securely attaching and quickly detaching from said module from the hand tool.

3. The module of claim 2 wherein said coupling means comprises a pair of sliding tracks.

4. The module of claim 3 wherein the hand tool includes a tool housing having a receiving portion configured to matingly receive said pair of sliding tracks.

5. The module of claim 4 wherein said receiving portion includes a pair of longitudinal recesses, each configured to matingly slidingly receive one of said pair of sliding tracks.

6. The module of claim 1 wherein a rear surface of said module housing is coextensive with a rear portion of the hand tool.

7. The module of claim 1 wherein said module housing further comprises a gripping surface.

8. The module of claim 7 wherein the gripping surface includes a plurality of scores disposed at a rear end portion of said module housing.

9. The module of claim 1 wherein said module housing includes a top surface that is generally coextensive with a top surface of the hand tool.

10. The module of claim 1 wherein said module housing is configured to have predetermined dimensions that generally correspond to a receiving portion disposed on the hand tool.

11. The module of claim 1 wherein said module housing comprises ABS.

12. The module of claim 1 further comprising an LED display disposed on said module housing.

13. The module of claim 1 further comprising a multiple position switch disposed on said module housing for controlling recording and playback modes of said module.

14. The module of claim 13 wherein said multiple position switch has at least a recording position and a playback position.

15. The module of claim 1 further comprising an actuator disposed on said module housing for activating either a recording mode or a playback mode.

16. The module of claim 1 wherein said measuring device is selectively detachable from said module housing.

17. The module of claim 1 wherein said measuring device is unitary with said module housing.

18. The module of claim 1 further comprising marking means disposed on said module housing.

19. The module of claim 18 wherein said marking means comprises a writing utensil.

20. The module of claim 18 wherein said marking means comprises a metal point.

21. The module of claim 1 wherein said measuring device comprises a tape measure that includes a spool housing and a measuring tape.

22. The module of claim 21 wherein said spool housing is configured and arranged so that a top surface is generally coextensive with a top surface of said module housing.

23. The module of claim 1 further comprising measurement indicia disposed on said module housing.

24. The module of claim 1 wherein said module is configured to have a predetermined length that corresponds to an integer unit measurement.

25. The module of claim 1 wherein said sound recording device is powered by a modular power source disposed within said module housing.

26. The module of claim 25 wherein said modular power source is a battery.

27. The module of claim 1 wherein said sound recording device is powered by an internal power source within the power tool.

28. A selectively detachable recording module for use with a hand tool comprising:

a module housing configured to be assembled to the hand tool; and a sound recording device disposed within said module housing.

29. The module of claim 28 further comprising a multiple position switch disposed on said module housing for controlling recording and playback modes of said module.

30. The module of claim 29 wherein said multiple position switch has at least a recording position and a playback position.

31. The module of claim 28 further comprising an actuator disposed on said module housing for activating either a recording mode or a playback mode.

32. The module of claim 28 wherein said module housing includes a top surface that is generally coextensive with a top surface of the hand tool.

33. The module of claim 28 wherein said module housing includes coupling means for securely attaching and quickly detaching from said module from the hand tool.

34. The module of claim 33 wherein said coupling means comprises a pair of sliding tracks.

35. A method of using a hand tool wherein the user is able to take and record measurements, as well as play back recorded measurements, including:

coupling a predetermined hand tool to a recording and measuring module;

taking measurements of a predetermined work surface with the recording and measuring module;

making a voice recording of the measurements with the recording and measuring module;

playing back the voice recording while using the hand tool on the predetermined work surface.

36. A combination measuring and recording module and hand tool having unitary construction comprising:

a generally cylindrical housing having an output shaft at a first end;

a measuring device disposed within said housing at a second end; and a sound recording and playback device disposed within said housing at said second end.

37. The combination of claim 36 further comprising a multiple position switch disposed on said housing for controlling recording and playback modes of said sound recording and playback device.

38. The combination of claim 36 wherein said multiple position switch has at least a recording position and a playback position.

39. The combination of claim 36 further comprising an actuator disposed on said housing for activating either a recording mode or a playback mode.

40. The combination of claim 36 wherein said measuring device is selectively detachable from said housing.

41. The combination of claim 36 wherein said measuring device is unitary with said housing.

42. The combination of claim 36 further comprising marking means disposed on said housing.

43. The combination of claim 42 wherein said marking means comprises a writing utensil.

44. The combination of claim 42 wherein said marking means comprises a sharpened point.

45. The combination of claim 36 wherein said measuring device comprises a tape measure that includes a spool housing and a measuring tape.

46. The combination of claim 45 wherein said spool housing is configured and arranged so that a top surface is generally coextensive with a top surface of said housing.

47. The combination of claim 36 further comprising measurement indicia disposed on said housing.

48. The combination of claim 36 wherein said housing is configured to have a predetermined length that corresponds to an integer unit measurement.

49. The combination of claim 36 wherein said sound recording device is powered by a modular power source disposed within said housing.

50. The combination of claim 49 wherein said modular power source is a battery.

51. The combination of claim 36 wherein said sound recording device is powered by an internal power source within the power tool.

52. A selectively detachable recording module for use with a hand tool having a generally cylindrical housing and a handle portion that is generally perpendicular to the housing comprising:

a module housing configured to be assembled to the hand tool at a top portion of the housing; and a measuring device disposed within said module housing.

* * * * *

UNITED STATES PATENT AND TRADEMARK OFFICE

CERTIFICATE OF CORRECTION

PATENT NO. : 6,868,571 B1
DATED : March 22, 2005
INVENTOR(S) : Fischer et al.

It is certified that error appears in the above-identified patent and that said Letters Patent is hereby corrected as shown below:

Column 1,
Line 38, delete “band” and insert -- hand --.

Column 2,
After Line 10, insert -- FIG. 11 is a perspective view of a module having only a measuring device. --.

Column 3,
Line 43, delete “care” and insert -- eave --.

Signed and Sealed this

Twenty-third Day of August, 2005

JON W. DUDAS
*Director of the United States Patent and Trademark Office*